US005361876A

United States Patent [19]

Haverick et al.

[11] Patent Number: 5,361,876

[45] Date of Patent: Nov. 8, 1994

[54] TRUCK MOUNTED BRAKE APPARATUS

[75] Inventors: Wallace F. Haverick, Easley; Paul P. Sopt, Taylors, both of S.C.

[73] Assignee: Ellcon National, Inc., Greenville, S.C.

[21] Appl. No.: 59,435

[22] Filed: May 4, 1993

[51] Int. Cl.[5] ..... B61H 13/00

[52] U.S. Cl. ..... 188/52; 188/219.1

[58] Field of Search ..... 188/52, 207, 208, 209, 188/210, 219.1

[56] References Cited

U.S. PATENT DOCUMENTS

| | | | |
|---|---|---|---|
| 2,815,092 | 12/1957 | Baselt | 188/52 |
| 2,838,143 | 6/1958 | Baselt | 188/210 |
| 4,312,428 | 1/1982 | Beacon | 188/52 |

*Primary Examiner*—Robert J. Oberleitner
*Assistant Examiner*—Kevin D. Rutherford
*Attorney, Agent, or Firm*—Brooks Haidt Haffner & DeLahunty

[57] ABSTRACT

Truck mounted brake apparatus includes a bracket assembly which clamps onto the bolster of a railway car truck and which includes a multiplying lever, which is connected to both a pull rod assembly and a hand brake. A truck live lever connected at one end to the pull rod assembly and at the opposite end to a standard brake beam is also connected intermediate its ends to one end of an automatic slack adjuster which passes through the bolster. A truck dead lever is connected at one end to the bracket assembly, at the opposite end to another standard brake beam, and is connected intermediate its ends to the opposite end of the slack adjuster. One end of the multiplying lever is connected to a hand brake. A fluid actuable piston and cylinder assembly is attached to the bolster and connected to the truck live lever, where movement of the piston and movement of the hand brake actuates the brakes.

18 Claims, 4 Drawing Sheets

TRUCK MOUNTED BRAKE APPARATUS

BACKGROUND OF THE INVENTION

1. Field of the Invention

This invention relates to truck mounted brake mechanisms for railway cars and more particularly to brake systems having means to increase the force applied by a hand brake to an actuating lever of the brake system.

2. Background and Objects of the Invention

Most railroad freight cars,use what is known as foundation brake rigging. On the car body, there is an air brake system which provides air to the brake cylinder, which, in turn, supplies a mechanical force, through a system of rods and levers to a connection on the standard freight car trucks located at each end of the car. At this point, the force is applied to a truck lever system, usually consisting of two levers and a connecting rod. The levers move Drake beams which apply force to the treads of the wheels through renewable friction blocks or brake shoes, retarding the rotation of the wheels.

One type of braking apparatus is shown and described in U.S. Pat. No. 4,312,428. In general, as illustrated in said patent, there is a manually operable mechanism connected to a lever of the air braking system for manually setting the brakes. The manually operable mechanism, also known as a "hand brake", usually comprises a manually rotatable wheel or a lever connected to reduction gears which rotate a chain drum for winding up a chain connected to a lever of the air braking system.

However, the manual force required to set-up the brakes is relatively high., and it is desirable to reduce such force. While the gear ratio could be changed, this requires additional activation of the hand wheel or lever and is relatively expensive.

One object of the invention is to increase the force applied to the brakes by the conventional hand brake driving mechanism without modifying the latter.

Another object of the invention is to reduce the forces on a support bracket which supports both a lever operable by the hand brake mechanism and a lever operated by the air braking apparatus.

Another object of the invention is to couple the hand brake driven lever to the brake actuating lever so that when the hand brake driven lever is in its release position, the air brake cylinder does not operate the hand brake mechanism.

SUMMARY OF THE INVENTION

In accordance with the preferred embodiment of the invention, a bracket assembly, which is clamped on one side of the bolster of a truck, includes a pivotably attached force multiplying lever which is connected to both a pull rod assembly and a hand brake linkage, such as a rod or chain, connected to a hand brake driven mechanism. At the opposite side of the bolster a truck live lever is connected at one end to the pull rod assembly and at the opposite end to a first standard brake beam and is also connected intermediate its ends to an automatic slack adjuster, passing through the bolster. A truck dead lever at said one side of the bolster is connected at one end to the bracket assembly and at its opposite end to a second standard brake beam, and is intermediately connected to the slack adjuster. A fluid actuable, piston and cylinder assembly is attached to the bolster and is connected to the truck live lever. Actuation of either the piston or of the hand brake mechanism in the brake applying direction actuates the brakes. Preferably, the pull rod assembly permits the force multiplying lever to pull the live lever to apply the brakes by hand but when the force multiplying lever is in the release position, also permits the live lever to move toward the force multiplying lever without movement of the latter.

BRIEF DESCRIPTION OF DRAWINGS

Other objects and advantages of the present invention will be apparent from the following detailed description of the presently preferred embodiments thereof, which description should be considered in conjunction with the accompanying drawings in which.

DETAILED DESCRIPTION OF THE PREFERRED EMBODIMENT

Figure 1:
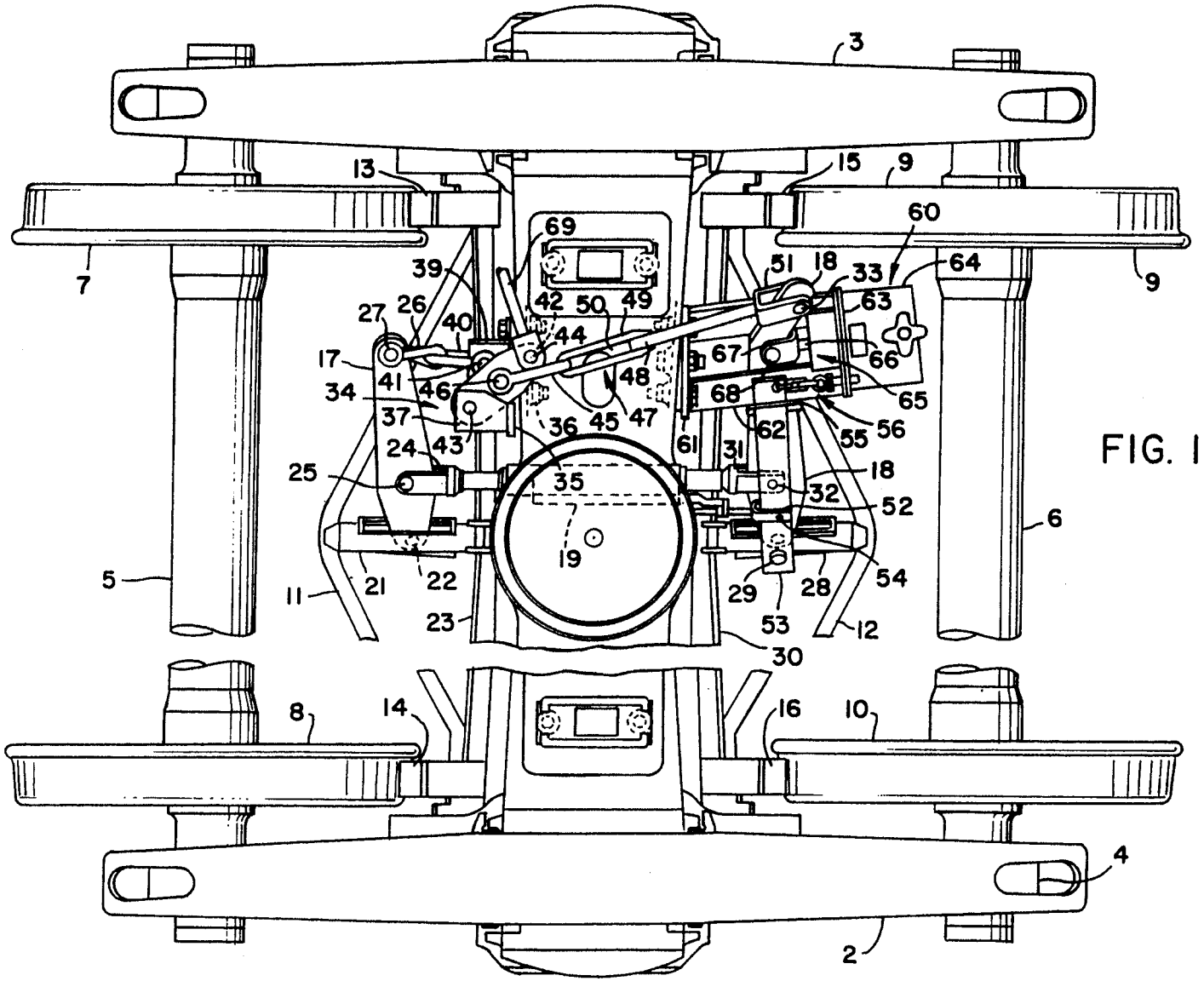
FIG. 1 is a top view of a railway car truck with the braking apparatus of the claimed invention thereon.

Although the present invention is not limited to such application, FIG. 1 illustrates the application of the invention to railway car truck of the type described and illustrated in said U.S. Pat. No. 4,312,428 and except for the addition of the apparatus of the invention, operates in substantially the same way as the apparatus in said U.S. Pat. No. 4,312,428. The truck comprises a bolster 1 supported by a pair of side frames 2 and 3 which carry bearings 4 which receive the axles 5 and 6 of the wheels 7–10 which ride on the railway rails. The railway car is supported at one end by the bolster 1, and a similar truck supports the opposite end of the railway car.

A pair of conventional brake beams 11 and 12 carry brake shoes at their opposite ends, the shoes 13 and 14 being at opposite ends of the beam 11 and shoes 15 and 16 being at opposite ends of the beam 12. When the brakes are actuated, the beams 11 and 12 press the brake shoes against the peripheries of the wheels 7–10 to brake the car.

Brake beam 11 is movable by a truck dead lever 17, and brake beam 12 is movable by a truck live lever 18. The levers 17 and 18 are preferably interconnected by a brake force transmitting means in the form of a floating, double acting, slack adjuster 19 of a known type which passes through openings, such as the opening 20 shown in FIGS. 3 and 4, normally found in bolsters in use. Truck dead lever 17 is pivotably connected at one end to a brake strut 21 by a pin 22. The strut 21 is attached at one end to brake beam arm 11 and at the other end to a brake beam cross member 23. Truck dead lever 17 is also pivotably connected intermediate its ends by a pin 25 to a yoke 24 attached to one end of the slack adjuster 19, and lever 17 is further pivotably connected at its opposite end to a clevis 26 by a pin 27.

Truck live lever 18 is pivotably connected at one end to a strut 28 by a pin 29. The strut 28 is attached at one end to brake beam arm 12 and at the other end to a brake beam cross member 30. Truck live lever 18 is also pivotably connected intermediate its ends to a yoke 31 at the other end of the slack adjuster 19 by a pin 32. Truck live lever 18 is also pivotably connected at its opposite end to a pull rod assembly 47 by a pin 33.

Figure 2:
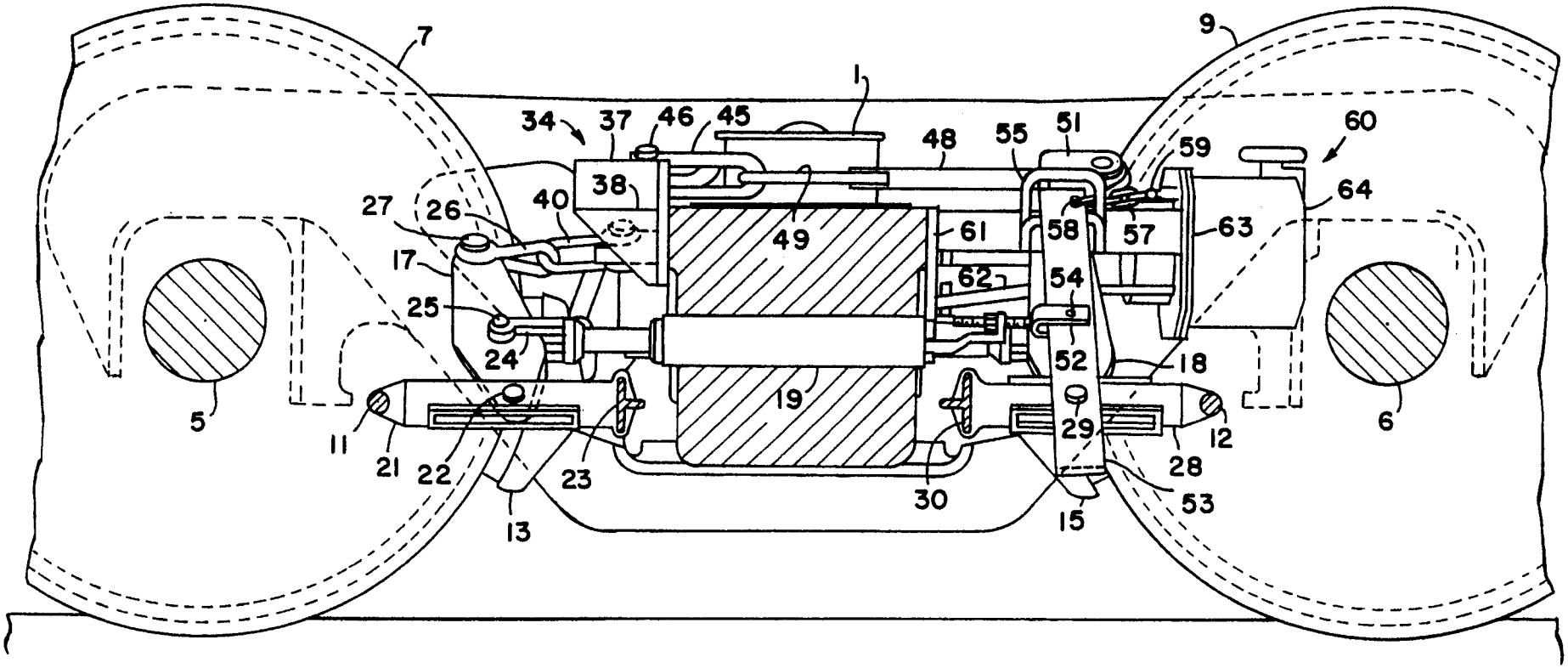
FIG. 2 is a side elevation view, partly in section, of the embodiment shown in FIG. 1.
Figure 3:
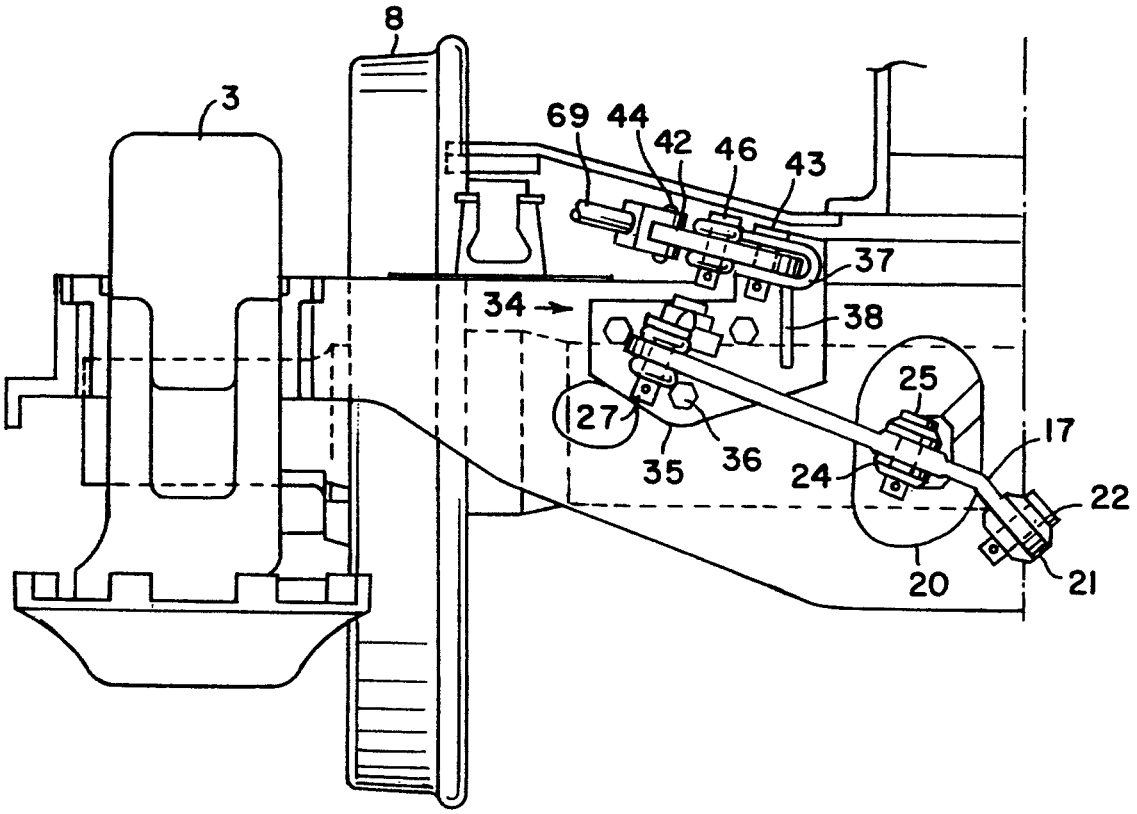
FIG. 3 is a left end elevation view of a portion of the apparatus shown in the preceding figures.
Figure 4:
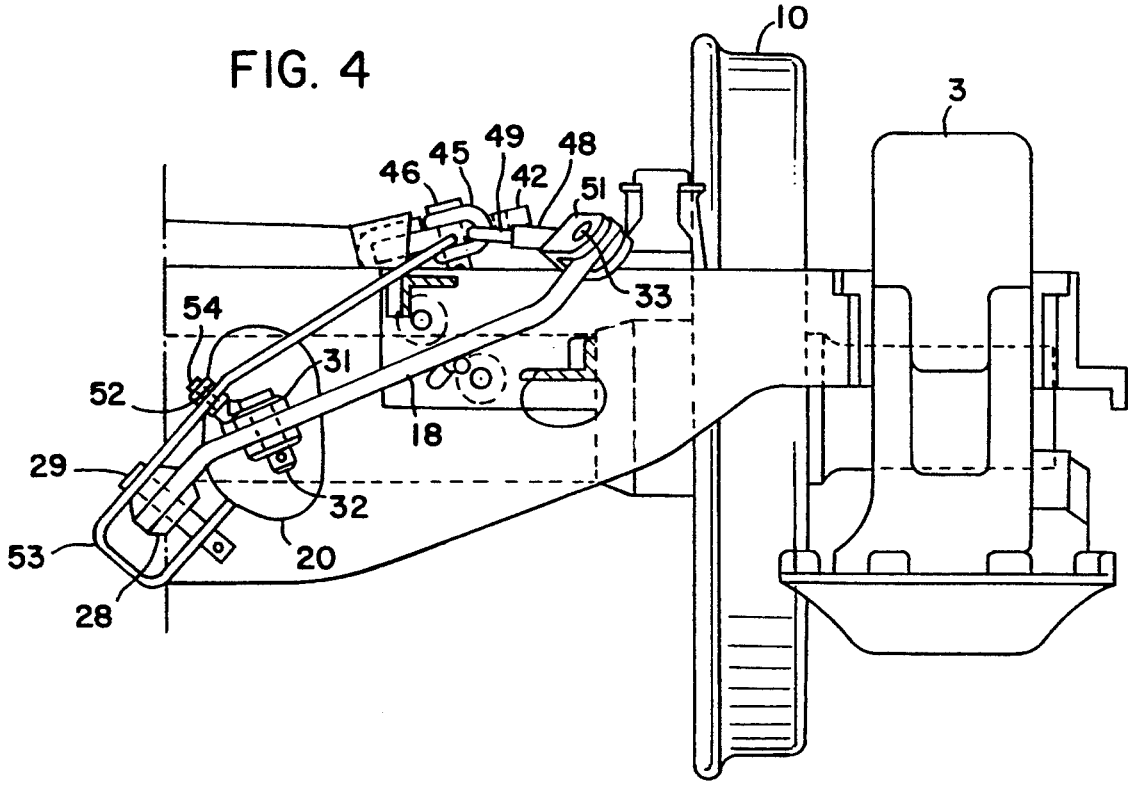
FIG. 4 is a right end elevation view of a portion of the apparatus shown in FIGS. 1 and 2.

Shown in FIGS. 1–3 is a force multiplying/dead lever bracket assembly 34, which includes a mounting plate 35 having mounting holes through which bolts 36 secure said plate 35 to the bolster 1. Attached to mounting plate 35 is a force multiplying lever bracket 37, the bracket 37 preferably being supported by a gusset 38 (shown in FIGS. 2 and 3). Also attached to said plate 35 is a bracket lug 39 for receiving a clevis 40 and a pin 41. Bracket lug 39 is preferably oriented at a substantially horizontal angle. Clevis 40, pivotally connected to the bracket lug 39, in turn interconnects with clevis 26, which as described above, is attached to truck dead lever 17 by pin 27.

As shown in FIG. 3, the force multiplying lever bracket 37 secured to said mounting plate 35, preferably, has a U-shape for pivotably receiving and supporting a force multiplying lever 42 and is oriented at an angle to the horizontal. Preferably bracket 37 supports said multiplying lever 42 at a slant, i.e. the U-shaped portion of bracket 37 preferably points slightly upwards, most preferably at an angle of approximately 15 degrees from horizontal. Bracket lug 39, as shown in FIG. 1, is also most preferably oriented at said 15 degree angle. Lever 42 is pivotably attached at one end to bracket 37 by a pin 43. The opposite end of multiplying lever 42 has a pin 44 for pivotal connection to a hand brake linkage or linkage means 69. Intermediate the ends of said force multiplying lever 42, a clevis 45, as shown in FIGS. 1 and 2, is pivotably attached to the lever 42 by a pin 46.

Shown in FIGS. 1 and 2, is a pull rod assembly or interconnecting means 47, which engages, at one end, the clevis 5 and at the other end, truck live lever 18, and preferably, includes a rod member 48 secured at one end to a link member 49 which engages the clevis 45, Link member 49, preferably, comprises a first portion secured to said rod member 48, as shown in FIG. 1, which has a slot 50 for telescoping slidable engagement with the clevis 45. The end wall of the slot 50 which is engageable with the clevis 45 forms stop means for limiting the separation of the lever 18 and the clevis 45. Because of the orientation of the lever 42, said first portion of link member 49 is normally oriented at an angle to the horizontal. Attached to the other end of said rod member 48 is a clevis member 51, which connects with said truck live lever 18 by pin 33. The orientation of U-shaped clevis member 51 is preferably rotated at an angle to receive the truck live lever 18, which preferably has a portion angled to receive said clevis 51. Preferably, clevis 51 is rotated approximately 45 degrees along an axis formed by said rod member 48. Because of the clevis 45 engaging the slotted portion 50 of link member 49, the pull rod assembly 47 does not rest upon the bolster surface when the hand brake is in release position.

Slack adjuster 19 may be of a known type and may, for example, be a slack adjuster of the type described and illustrated in U.S. Pat. Nos. 3,406,794 or 3,850,269. The trigger or actuator of the slack adjuster 19 is connected to a control arm assembly 52 which is pivotably connected to an actuating lever 53 by a pin 54. The actuating lever 53 is pivotably connected at one end to both brake strut 28 and to one end of truck live lever 18 by the pin 29. Movement of the opposite end of the actuating lever 53 is limited by guides 55 which act as stop means. As shown in FIGS. 1 and 2, guides 55 are preferably attached to the sides of a cylinder assembly 60. A chain assembly 56, as shown in FIG. 1, preferably includes a chain 57 attached to said opposite end of said actuating lever 53 by a pin and shackle 58, as shown in FIG. 2. The other end of chain 57 is also attached to a pin and shackle 59. Accordingly, the slack adjuster 19 is actuated by the actuating lever 53 and operates as described in said patents to take up excess slack or to compensate for the replacement of worn brake shoes by new brake shoes.

Shown in FIGS. 1 and 2 is cylinder assembly 60 which is mounted to the side of said bolster 1 by a mounting plate 61. A support structure 62 connects said mounting plate 61 to a further plate 63 to which a cylinder 64 is secured. As shown in FIG. 2, the pin and shackle 59 of chain assembly 56 is attached to said plate 63. A push rod assembly 65, as shown in FIG. 1, connects cylinder 64 with truck live lever 18 for braking the car. Push rod assembly 65 includes a piston rod 66 which moves outward from said cylinder 64 in response to application of air pressure, and a piston yoke 67 which is attached to said truck live lever 18 by a pin 68. Piston yoke 67, when pushed by piston rod 66, applies the brakes as described in said U.S. Pat. No. 4,312,428.

As illustrated in said U.S. Pat. No. 4,312,428, it is conventional to connect the linkage operable by the hand brake mechanism directly to the live lever 18. In other words, the force applied to the live lever 18, and hence, the brake shoes, depends upon the force which can be applied by the hand brake, a manually operable mechanism. As pointed out hereinbefore, however, it is desirable to reduce the manual force required to set the brakes properly.

In the embodiment of the invention shown, the hand brake linkage 69 is not connected directly to the lever engaging and operable by the piston of the air cylinder and piston assembly. Instead, the hand brake linkage 69 is connected to the last-mentioned lever 18 thru a force multiplying lever 42 and a pull rod assembly 47. In this way, the force applied to the brake shoes 13–16 can be increased without modifying the hand brake mechanism, and with lower manual forces, depending on the lever ratio of the lever 42.

While a different ratio can be used, in the preferred embodiment of the invention as shown and described, the force applied to the brake shoes 13–16 is approximately doubled with the same amount of manual force on the wheel or lever of the hand brake mechanism which is manually operable. Thus, in the preferred embodiment illustrated, the lever 42 pivots about the axis of the pin 43, the clevis 45 is pivotably connected to the lever 42 by a pin 46 and the hand brake linkage 69 is pivotably connected to the lever 42 by a pin 44. In the preferred embodiment, the distance between the axes of the pins 43 and 44 is twice the distance between the axes of the pins 43 and 46 so that the force applied to the pull rod assembly is twice the force applied to the lever 42 by the hand brake linkage 69.

Figure 5:
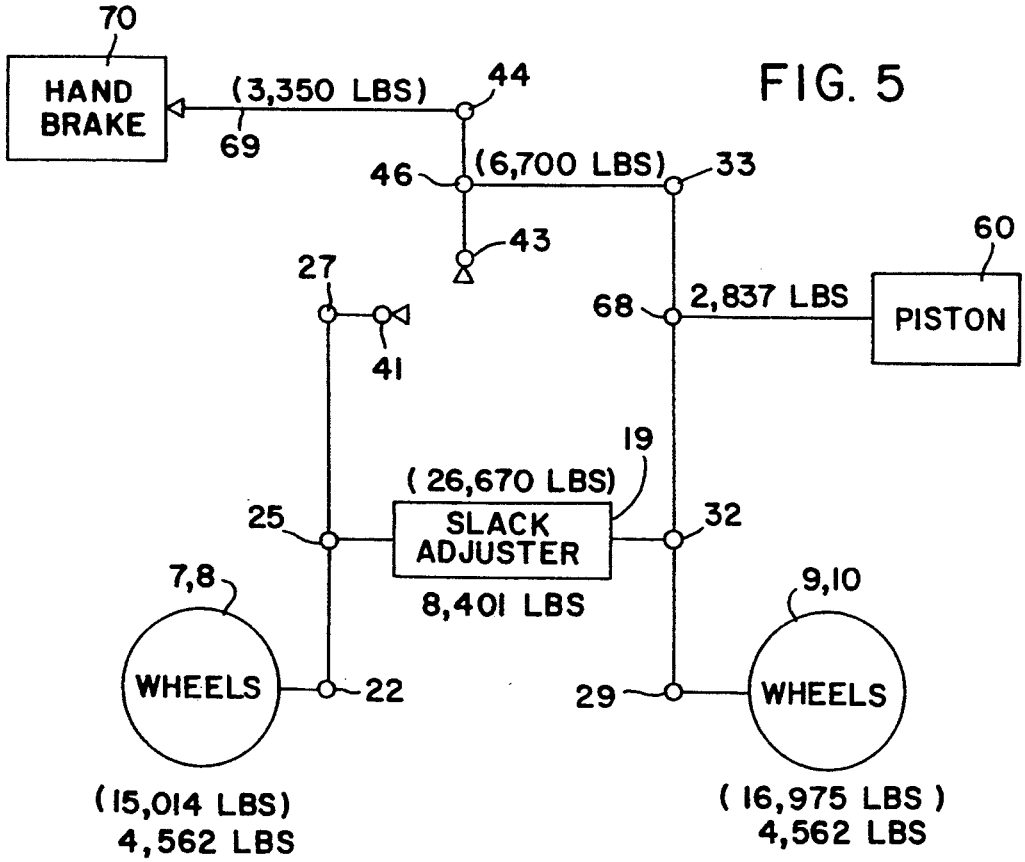
FIG. 5 is a force diagram showing the various component forces present in the embodiment shown in FIGS. 1–4.

The force diagram of FIG. 5 illustrates typical braking forces and the force multiplication advantages of the present invention. As shown in FIG. 5, force applied by a manually operable, hand brake, drive mechanism 70 to said bracket assembly 34 is first transmitted to pin 44 at one end of said multiplying lever 42, rotating said lever 42 about pin 43 in said lever bracket 37. Clevis 45 is attached at one end to said lever 42 by pin 46 and at the other end to said pull rod assembly 47, which in turn connects said clevis member 51 by pin 33 to a first end of truck live lever 18, increasing the hand brake force applied to said live lever 18 two-fold, e.g., from 3,350 to 6,700 pounds. The stepped-up force applied to said live lever 18 is then transmitted and further stepped-up through pins 29 and 32 of said actuator lever 53 to slack adjuster 19, which in turn pivots said dead lever 17 about pin 25. As shown in FIG. 5, slack adjuster 19 transmits a force of approximately 26,670 pounds to pin 25 of truck dead lever 17. One end of said dead lever 17 connects to said bracket lug 39 by pin 27, which in turn connects to said mounting plate 35 of said bracket assembly 34 by pin 41. The stepped-up forces distributed to both truck levers 17 and 18 is also transferred by pins 22 and 29, respectively, to struts 21 and 28, and brake beam arms 11 and 12 for pressing said brake shoes 13–16 against said wheels 7–10. For example, as shown in FIG. 5, pin 29 of said truck live lever 18 transfers approximately 16,975 pounds and pin 22 of said truck live lever 17 transfers approximately 15,014 pounds of brake pressure to the wheels 7–10, both at approximately 85% efficiency. Thus, the configuration of the present invention as shown in FIG. 5 increases the hand brake output force applied to the live lever 18 several fold, preferably two-fold, a significant reduction of the force necessary to set a truck hand brake.

As also shown in FIG. 5, push rod assembly 65 of cylinder assembly 60 may also be employed to brake the car. Preferably, the movement of piston rod 66, connected to said live lever 18 by said pin 68, is confined to a limited range so as to maintain uniform truck braking on a given railway. The preferred piston range in the present invention is 2.25 to 3.75 inches, and the piston force of the present embodiment delivered to live lever 18 is approximately 2,837 pounds. Slack adjuster 19 preferably maintains the specified piston range and also compensates for brake shoe wear. As further shown in FIG. 5, slack adjuster 19 transmits a force of approximately 8,401 pounds across to pin 25 of truck dead lever 17, and both pins 22 and 29 then transfer approximately 4,562 pounds of brake pressure to wheels 7–10 at approximately 82% efficiency.

An advantage of the present invention is that the bracket assembly 34 provides an anchoring point for both the multiplying lever 42 and the dead lever 17. Thus, the bracket assembly 34 of the present design combines the functions of the "common" truck dead lever 17, e.g., dead lever bracket lug 38, with the force multiplication advantages of the multiplying lever 42, thereby providing a compact mount for the dual functions in essentially the same space.

Another advantage of the present invention is the reduction of tension force on the mounting plate 35 when the brakes are applied by both the hand brake mechanism 69 and the air brake cylinder assembly 60. Thus, the pull of dead lever 17 upon the plate 35 is partially counterbalanced by an opposite compressive force generated by the force multiplying lever 42 against bracket assembly 34, where tension forces generated by the dead lever 17 during hand brake application are reduced approximately 37%. It will be noted that the lever 42 presses the plate 35 against the bolster rather than applying a pulling force thereto.

Another feature of the present invention is that the pull rod assembly 47 does not rest upon the bolster 1 when the hand brake is in the release position. The present design makes use of the position of pin 46 supporting clevis 45 on the force multiplying lever 42 to prevent engagement of the assembly 47 with the bolster 1. As shown in FIGS. 1 and 2, clevis 45 telescopically engages and supports said pull rod assembly 47 above the surface of bolster 1, and no additional support system is required to prevent such contact.

A further feature of the present design is the ability of the pull rod assembly 47 to "telescope" in length when the brakes are applied by the air brake cylinder. Thus, the clevis 45 can move within the slotted portion 50 of link member 49 of pull rod assembly 47 when the hand brake is in release position and the air brake cylinder is charged. Due to this telescoping action, the air brake cylinder moves only the pull rod assembly 47 and not the hand brake linkage, making the system more efficient.

Although preferred embodiments of the present invention have been described and illustrated, it will be apparent to those skilled in the art that various modifications may be made without departing from the principles of the invention.

What is claimed is:

1. In a vehicle having rotatable wheels and braking apparatus comprising friction means for frictionally engaging said wheels, a pivotable :lever for pressing said friction means against said wheels for resisting rotation of said wheels and a manually operable driving means for operating said pivotable lever, wherein the improvement comprises a force multiplying lever pivotably mounted at one end on said vehicle to provide a predetermined pivot point at said one end, means interconnecting said force multiplying lever at a second point, spaced from said predetermined point in a predetermined direction, with said pivotable lever for moving said pivotable lever with movement of said multiplying lever and means interconnecting said manually operable driving means with said force multiplying lever at a third point on the latter spaced in said predetermined direction and further from said pivot point than said second point whereby the force applied to said pivotable lever, and hence, said friction means, is greater than the force applied to said force multiplying means by said manually operable driving means.

2. Braking apparatus as set forth in claim 1 wherein said vehicle is a railway car having a bolster supported by said wheels and wherein said force multiplying lever is pivotably mounted on said bolster.

3. Braking apparatus asset forth in claim 2 further comprising a bracket secured to said bolster wherein said force multiplying lever is pivotably connected to said bracket.

4. Braking apparatus as set forth in claim 3 wherein said force multiplying lever is pivotably connected to said bracket so that said force multiplying lever moves in a plane at an angle to the horizontal.

5. Braking apparatus as set forth in claim 4 wherein said angle is substantially equal to fifteen degrees.

6. Braking apparatuses set forth in claim 3 wherein said third point on said force multiplying lever is over and spaced from and vertically above said bolster.

7. Braking apparatus as set forth in claim 2 wherein said means interconnecting said force multiplying lever and said pivotable lever comprises connection means which permits movement of said pivotable lever toward said force multiplying lever but limits movement of said force multiplying lever away from said pivotable lever whereby movement of said pivotable lever toward said force multiplying lever does not move the latter lever whereas movement of said force multiplying lever away from said pivotable lever causes movement of the latter lever.

8. In a railway vehicle having a truck with a bolster supported by first and second pairs of rotatable wheels, the wheels of each pair of wheels being spaced apart horizontally and said first pair of wheels being spaced horizontally from said second pair of wheels, braking apparatus comprising first movable mounting means carrying a first pair of brake shoes movable in a first predetermined direction, one of which shoes is engageable with one of the wheels of the first pair of wheels and the other of which shoes is engageable with the other of the wheels of the first pair of wheels for arresting rotation of said first pair of wheels, second movable mounting means carrying a second pair of brake shoes movable in a second direction opposite to said first predetermined direction, one of said second pair of brake shoes being engageable with one of the wheels of said second pair of wheels and the other of said second pair of brake shoes being engageable with the other of said second pair of wheels, a fluid operable piston and cylinder assembly mounted on said bolster, first lever means interconnecting said piston and cylinder assembly with said first movable mounting means for moving the latter, second lever means interconnecting said piston and cylinder assembly with said second movable mounting means for moving the latter, a manually operable drive means and linkage means interconnecting said drive means and at least one of said first lever means and said second lever means wherein the improvement is that said linkage means comprises:

a force multiplying lever pivotably mounted at one end on said bolster to provide a predetermined pivot, first point at said one end;

first connecting means interconnecting said drive means with said lever at a second point thereon spaced from said pivot point in a predetermined direction; and second connecting means interconnecting said one of said first lever means and said second lever means with said lever at a third point spaced from said pivot point in said predetermined direction by an amount less than the spacing between said first point and said pivot point.

9. Braking apparatus as set forth in claim 8 further comprising a bracket secured to said bolster and wherein said force multiplying lever is pivotally mounted on said bracket and said second connecting means interconnects said force multiplying lever and said first lever means.

10. Braking apparatus as set forth in claim 9 wherein said second connecting means comprises connection means which permits movement of said first lever means toward said force multiplying lever but limits movement of said force multiplying lever away from said first lever means whereby movement of said first lever means toward said force multiplying lever does not move the latter lever whereas movement of said force multiplying lever away from said first lever means causes movement of the latter lever.

11. Braking apparatus as set forth in claim 10 wherein said connection means comprises a rod pivotably connected to one of said force multiplying lever and said first lever means and a link connected to said rod and slidably and pivotably connected to the other of said force multiplying lever and said first lever means, said link having stop means limiting movement of said force multiplying lever away from said first lever means.

12. Brake apparatus as set forth in claim 11 wherein said link comprises a slot and is pivotably connected to said other of said force multiplying lever and said first lever means by a clevis pivotably mounted on said other of said force multiplying lever and said pivotable lever and extending thru said slot.

13. Braking apparatus as set forth in claim 9 wherein said force multiplying lever is pivotably connected to said bracket so that said force multiplying lever moves in a plane at an angle to the horizontal.

14. Braking apparatus as set forth in claim 13 wherein said angle is substantially equal to fifteen degrees.

15. Braking apparatus as set forth in claim 9 wherein said third point on said force multiplying lever is over and spaced from and vertically above said bolster.

16. In a railway car vehicle having two pairs of rotatable wheels and braking apparatus comprising friction means for frictionally engaging said wheels, said friction means having a first pair of shoes movable in first direction to engage one pair of said pairs of wheels and a second pair of shoes movable in a second, opposite direction to engage the other of said pairs of wheels, a pivotable first lever for pressing said first pair of shoes against said wheels for resisting rotation of said wheels, a pivotable second lever interconnected with the first-mentioned said pivotable lever and a fluid operable piston and cylinder assembly connected to said pivotable first lever for moving said first lever and causing movement of said first pair of brake shoes in said first direction and causing movement of an end of said pivotable second lever and said second pair of brake shoes in said second direction, a bolster supported by said wheels, a bracket secured to said bolster, and a manually operable driving means for operating said pivotable lever, wherein the improvement comprises a force multiplying lever pivotably connected to said bracket and having a predetermined pivot point, means interconnecting said force multiplying lever at a second point, spaced from said predetermined point, with said pivotable first lever for moving said pivotable first lever with movement of said force multiplying lever and means interconnecting said manually operable driving means with said force multiplying lever at a third point on the latter spaced further from said pivot point than said second point whereby the force applied to said pivotable first lever, and hence, said friction means, is greater than the force applied to said force multiplying means by said manually operable driving means, said end of said second lever being pivotably connected to said bracket and when said fluid operable piston and cylinder assembly is activated to engage said first pair of shoes with said one pair of wheels, applies a force to said bracket in said second direction, and said force multiplying lever being operable by said manually operable driving means in a direction in which, at its pivotal connection to said bracket, applies a force to said bracket in said first direction when said manually operable mechanism is activated to move said shoes into engagement with said wheels.

17. In a vehicle having rotatable wheels and braking apparatus comprising friction means for frictionally engaging said wheels, a bolster supported by such wheels, a pivotable lever for pressing said friction means against said wheels for resisting rotation of said wheels and a manually operable driving means for operating said pivotable lever, wherein the improvement comprises a force multiplying lever pivotably mounted on said bolster and having a predetermined pivot point, means interconnecting said force multiplying lever at a second point, spaced from said predetermined point, with said pivotable lever for moving said pivotable lever with movement of said force multiplying lever and means interconnecting said manually operable driving means with said force multiplying lever at a third point on the latter spaced further from said pivot point than said second point whereby the force applied to said pivotable lever, and hence, said friction means, is greater than the force applied to said force multiplying means by said manually operable driving means, said means interconnecting said force multiplying lever and said pivotable lever comprising connection means which permits movement of said pivotable lever toward said force multiplying lever but limits movement of said force multiplying lever away from said pivotable lever whereby movement of said pivotable lever toward said force multiplying lever does not move the latter lever whereas movement of said force multiplying lever away from said pivotable lever causes movement of the latter lever, and said connection means positioned directly above the bolster, comprising a rod pivotably connected to one of said force multiplying lever and said pivotable lever and a link secured to said rod and slidably and pivotably connected to the other of said force multiplying lever and said pivotable lever, said link having stop means limiting movement of said force multiplying lever away from said pivotable lever.

18. Braking apparatus as set forth in claim 17 wherein said link comprises a slot and is pivotably connected to said other of said force multiplying lever and said pivotable lever by a clevis pivotably mounted on said other of said force multiplying lever and said pivotable lever and extending thru said slot.

* * * * *

UNITED STATES PATENT AND TRADEMARK OFFICE

CERTIFICATE OF CORRECTION

PATENT NO. : 5,361,876
DATED : November 8, 1994
INVENTOR(S) : Haverick et al

It is certified that error appears in the above-indentified patent and that said Letters Patent is hereby corrected as shown below:

Col. 1, line 11, "cars,use" should read --cars use--.

Col. 3, line 38, after "45" change the comma (,) to a period (.);
Col. 6, line 47 "asset" should read --as set--;
Col. 6, line 57, "apparatuses" should read --apparatus as--;
Col. 10, line 4, after "bolster" delete the comma (,).

Signed and Sealed this

Seventh Day of March, 1995

*Attest:*

Bruce Lehman

BRUCE LEHMAN

*Attesting Officer*

*Commissioner of Patents and Trademarks*